US005088954A

United States Patent [19]

Terzian et al.

[11] Patent Number: 5,088,954

[45] Date of Patent: Feb. 18, 1992

[54] MANUALLY ASSISTED AND CONTROLLED WALKING DOLL

[75] Inventors: Rouben T. Terzian, Chicago; Donald A. Rosenwinkel, Oak Park, both of Ill.

[73] Assignee: Breslow, Morrison, Terzian & Associates, Inc., Chicago, Ill.

[21] Appl. No.: 646,167

[22] Filed: Jan. 25, 1991

[51] Int. Cl.[5] ..... A63H 11/18

[52] U.S. Cl. ..... 446/355; 446/484; 446/338

[58] Field of Search ..... 446/355, 354, 484, 369, 446/391, 338, 352, 353, 356

[56] References Cited

U.S. PATENT DOCUMENTS

| | | | |
|---|---|---|---|
| 844,577 | 2/1907 | Borchardt | 446/484 X |
| 3,456,384 | 7/1969 | Gardel et al. | 446/355 |
| 3,858,353 | 1/1975 | Glass et al. | 446/354 |

FOREIGN PATENT DOCUMENTS

| | | | |
|---|---|---|---|
| 2380045 | 9/1978 | France | 446/484 |

*Primary Examiner*—Mickey Yu

*Attorney, Agent, or Firm*—Dick and Harris

[57] ABSTRACT

A doll with articulated legs that are motor driven to pivot in an alternating, out-of-phase, motion to simulate walking has switch controls actuatable by user manipulation of an arm and hand of the doll. Rotation of the arm energizes the motor while squeezing a depressible portion of the hand selectively increases the power to the motor and hence the walking speed of the doll.

8 Claims, 4 Drawing Sheets

MANUALLY ASSISTED AND CONTROLLED WALKING DOLL

BACKGROUND OF THE INVENTION

1. Field of the Invention

This invention relates generally to dolls with articulated legs that simulate walking and more particularly to controls for dolls having motor driven articulated legs for simulating walking.

2. Background Art

Dolls with motor driven movable legs for simulating walking are old in the art. Thus, for example, dolls with battery motor driven legs are shown in Ryan U.S. Pat. No. 3,243,916 issued Apr. 5, 1966; Ryan U.S. Pat. No. 3,267,607 issued Aug. 23, 1966 and Ceccon U.S. Pat. No. 3,604,147 issued Sept. 14, 1971, all without any showing of controls for actuating the motor driven legs. Other prior art such as Robbins U.S. Pat. No. 3,484,988 issued Dec. 23, 1969; Gardel et al. U.S. Pat. No. 3,609,909 issued Oct. 5, 1971 and Terzian U.S. Pat. No. 4,878,874 issued Nov. 7, 1989 disclose dolls or characters with battery motor driven legs having a switch on the back of the torso. Still other prior art such as Douglas et al. U.S. Pat. No. 3,475,857 issued Nov. 4, 1969; Ryan U.S. Pat. 3,267,608 issued Aug. 23, 1966; Gardel et al. U.S. Pat. No. 3,421,258 issued Jan. 14, 1969; Lindsay et al. U.S. Pat. No. 3,425,154 issued Feb. 4, 1969 and Ryan U.S. Pat. No. 3,445,960 issued May 27, 1969 show dolls with battery motor driven legs that have both a switch on the back of the torso plus a gravity switch for deenergizing the motor when the doll is not erect. In addition, prior art examples of dolls supported by an accessory for simulated walking are shown in Paluck U.S. Pat. No. 1,684,287 issued Sept. 11, 1928; Schneider U.S. Pat. No. 3,453,772 issued July 8, 1969; Douglas et al. U.S. Pat. No. 3,475,857 issued Nov. 4, 1969; Glass et al. U.S. Pat. No. 3,940,879 issued Mar. 2, 1976; Terzian et al. U.S. Pat. No. 4,386,479 issued June 7, 1983; Terzian et al. U.S. Pat. No. 4,467,555 issued Aug. 28, 1984; and Herbstler et al. U.S. Pat. No. 4,824,415 issued Apr. 25, 1989. Terzian U.S. Pat. No. 4,507,098 issued Mar. 26, 1985 discloses a roller skating doll having spring motor driven articulated legs, battery motor versions of which were later manufactured having an on/off switch on the torso. However, there remains a need for a doll with legs that are driven in response to user manipulation of the doll's arm and/or hand to simulate a toddler walking in response to encouragement by a parent holding the toddler's arms.

SUMMARY OF THE INVENTION

The present invention is concerned with providing a doll with articulated legs that are motor driven to simulate walking in response to user actuation of a switch controlled by holding a hand of the doll as a parent would that of a toddler. One switch is actuated by the rotational positioning of an arm of the doll. Another switch is actuated by depressing a movable portion of the hand of the doll.

BRIEF DESCRIPTION OF THE DRAWINGS

For a better understanding of the present invention, reference may be had to the accompanying drawings in which.

DETAILED DESCRIPTION

Figure 1:
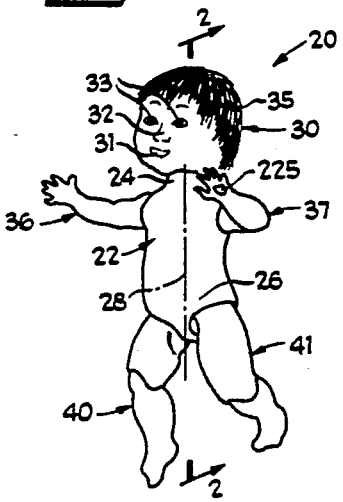
FIG. 1 is a perspective view of a doll embodying the present invention.

Referring now to the drawings in which like parts are designated by like reference numerals throughout the several views, FIG. 1 shows a doll 20 having a torso 22 which includes an upper neck end 24 and a lower pelvic end 26. A central axis 28 extends through the torso from neck end 24 to pelvic end 26. Carried atop neck end 24 of torso 22 is a head 30. Conveniently, head 30 is provided with a mouth 31, nose 32, eyes 33 and hair 35. Doll 20 also includes a pair of arms 36 and 37 plus a pair of legs 40 and 41.

Figure 5:
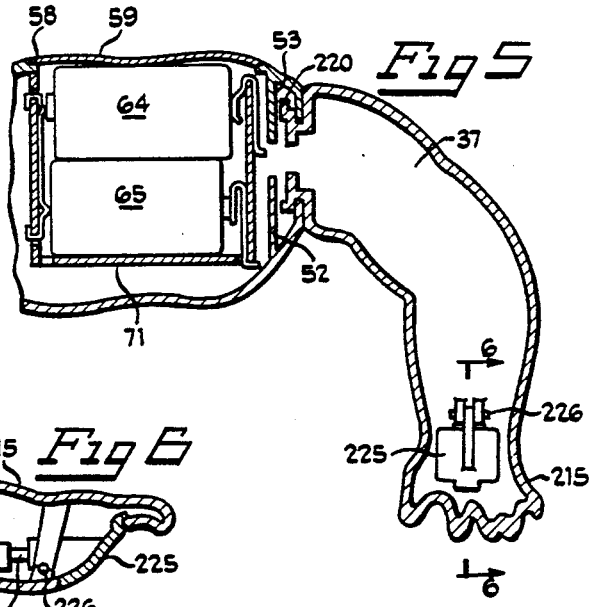
FIG. 5 is a fragmentary sectional view taken generally along line 5—5 of FIG. 2.

Torso 22, which is substantially hollow, is formed of a front part 42 and a back part 43. Extending inwardly from front torso part 42 is an upper post 44 which is adapted to generally align with, and abut, an inwardly directed boss 45. Similarly, a lower inwardly extending post 46 extends from front torso part 42 towards, and generally in alignment with, a lower boss 47 directed inwardly from back torso part 43. Each of parts 42 and 43 has a respective edge 48 and 49 that mates with the edge of the other part when torso parts 42 and 43 are assembled. Formed in opposite sides of mating edge 48 of front torso part 42 there are semi-circular cut-outs 50 each of which substantially aligns with a corresponding one of similar semi-circular cut-outs 51 formed in mating edge 49 on each opposed side of back torso part 43. Spaced laterally inwardly from each of semi-circular cut-outs 50 is an abutment or wall 52 that is formed as part of front torso part 42. There is a similar laterally inwardly spaced abutment or wall 53 adjacent each semi-circular cut-out 51 on back torso part 43. Each of mating edges 42 and 43 has a respective slot defining notch 54 and 55. Adjacent lower pelvic end 26, front torso piece 42 is formed with leg openings 56 t hat are aligned with similarly formed leg openings 57 in back torso piece 43 for receiving legs 40 and 41. Also included in back torso part 43 is a battery access portal 58. A removable closure 59, which is best shown in FIGS. 3 and 5, fits into portal 58.

Mounted within torso 22, or more particularly between front and back torso parts 42 and 43, respectively, is a housing 60 that is formed of a back portion 61 and a front portion 62. Housing 60 carries batteries 64 and 65, motor 67, head pivoting mechanism 68 and leg drive mechanism 70. More particularly, batteries 64 and 65 are disposed within an upper container 71 of back housing portion 61. Battery container 71 is open and is accessible through portal 58. On the front of battery container 71 is a seat 72 having an aperture 73. Disposed below battery container 71 is gear casing section 74. Extending inwardly from casing section 74 is an upper boss 75, which is best shown in FIG. 3. Upper boss 75 has a blind bore 76. Casing section 74 also has a generally centrally disposed, inwardly directed boss 77 which has a blind bore 78. Also extending inwardly, generally parallel to bosses 75 and 77, is a generally centrally disposed flat member 79. Depending downwardly from casing section 74 is a stem 81 having a bore 82 with a counterbore 83 on each side of stem 81.

Figure 10:
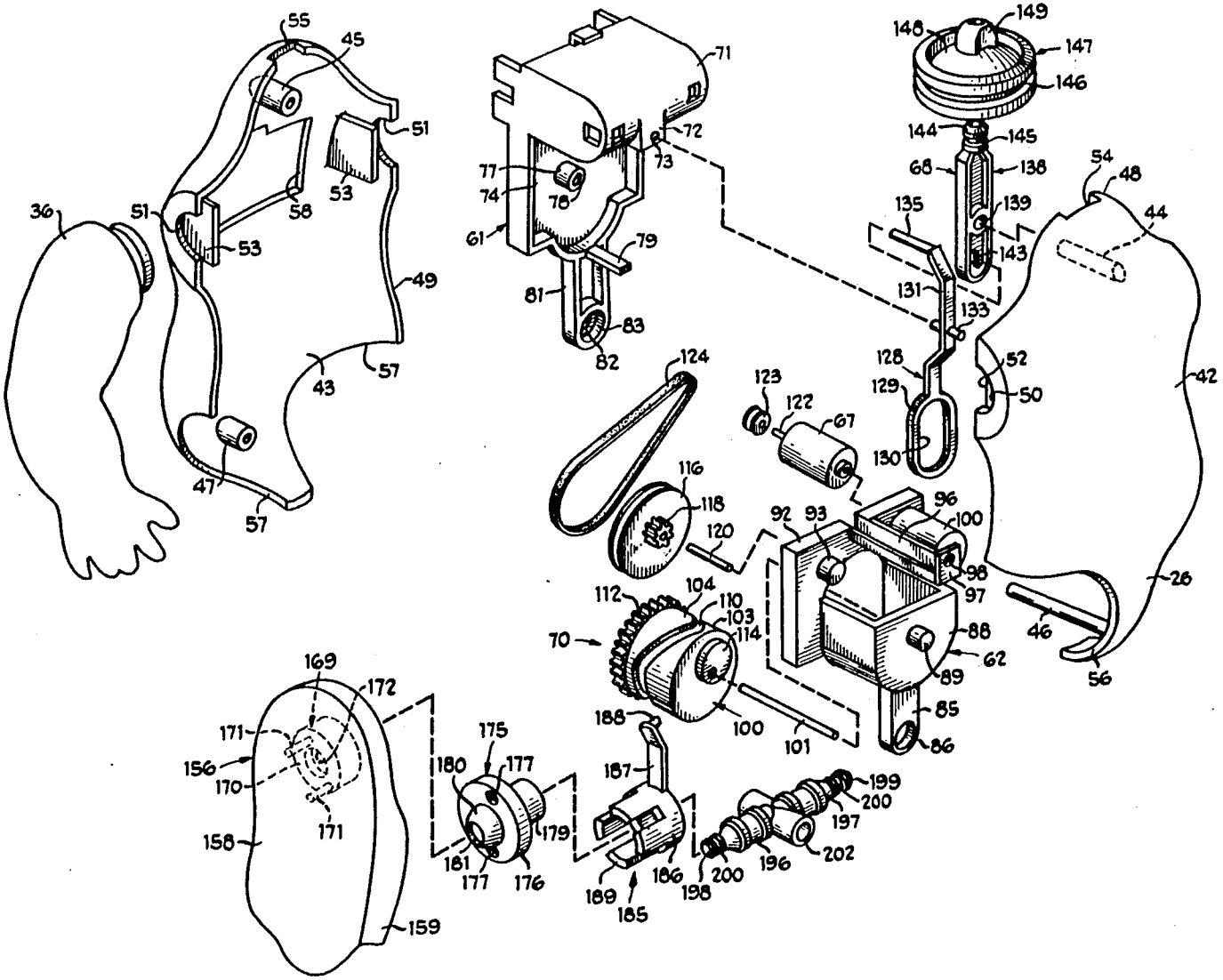
FIG. 10 is a fragmentary perspective exploded view.

Front housing portion 62 also has a depending stem 85. Adjacent the bottom of stem 85 is a bore 86 having a diameter approximately equal to that of counterbores 83 in stem 81. Disposed above stem 85, as shown in FIGS. 3 and 10, is gear casing well section 88 which includes an outwardly extending boss 89 having a blind bore 90. Casing well section 88 extends outwardly from stem 85. Generally parallel to, and inboard of, stem 85 is a casing wall section 92 which is integrally formed with casing well section 88. Extending outwardly from casing wall section 92 is a boss 93 which has a blind bore 94. Also extending outwardly from casing wall section 92 of front housing portion 62 is a generally laterally centrally disposed, outwardly extending trough 96 having a end plate 97 with an aperture 98. Disposed on the other side of trough 96 from boss 93 is an outwardly extending hollow cylindrical projection 100 that receives motor 67.

Figure 3:
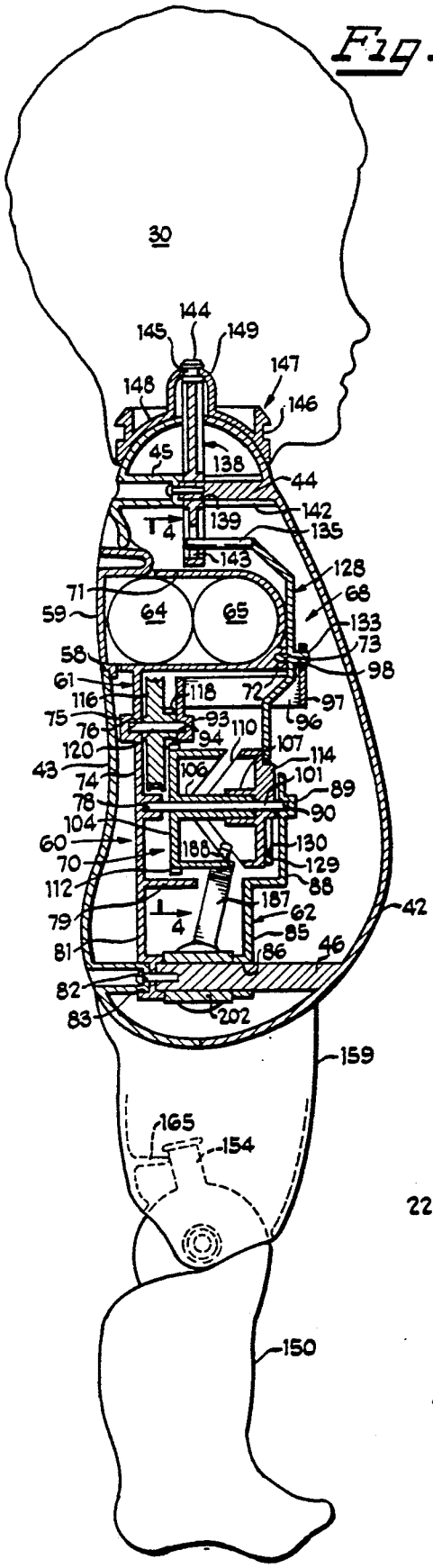
FIG. 3 is a sectional view taken generally along line 3—3 of FIG. 2.
Figure 4:
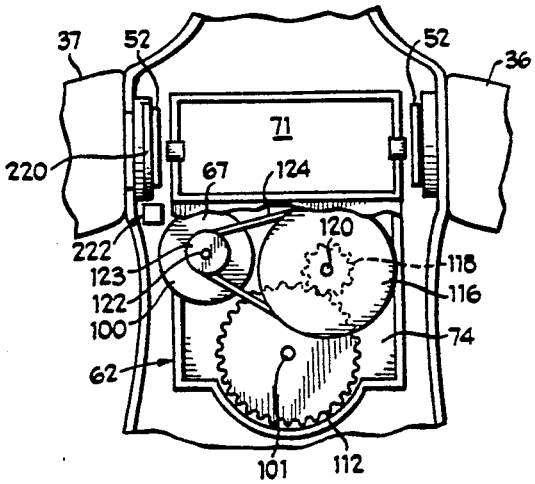
FIG. 4 is a fragmentary sectional view taken generally along line 4—4 of FIG. 3.

As will perhaps best be appreciated from FIG. 3, when back housing portion 61 and front housing portion 62 are assembled to each other, bore 86 of stem 85 and counterbores 83 of stem 81 are aligned and receive lower post 46 of front torso part 42. Blind bores 78 and 90 of bosses 77 and 89, respectively, are aligned and blind bores 76 and 94 of bosses 75 and 93, respectively, are also aligned when the front and rear housing portions are assembled. In addition, seat 72 is disposed above trough 96 in proximity to plate 97 with the respective apertures 73 and 98 aligned when housing portions 61 and 62 are assembled. Additional bosses (not shown) are conveniently provided for mounting housing portions 61 and 62 to each other and to torso 22.

Disposed in housing 60, more particularly, in the casing defined by casing section 74, casing well section 88 and casing wall section 92 is a cam gear 100 which is mounted for rotation about a shaft 101. Each of the opposed ends of shaft 101 is received in a respective one of blind bores 78 and 90 of bosses 77 and 89. As is perhaps best shown in FIG. 3, cam gear 100 is formed of two pieces 103 and 104 that are pressfit together. More particularly, piece 104 has an inwardly directed stem 106 that is received in an inwardly directed blind bore boss 107 of piece 103. When pressfit together pieces 103 and 104 are coaxially aligned about shaft 101 and axially spaced apart so that their inboard edges form an alternately angling or generally sinusoidal cam slot 110. The rearward face of piece 104 includes a gear 112 while the forward face of piece 103 includes an offset generally cylindrical face cam projection 114.

Also disposed within the gear casing section of housing 60 is a integral coaxial pulley 116 and a pinion gear 118. The integral pulley and pinion are mounted for rotation about shaft 120 which is journaled in aligned bores 76 and 94 of bosses 75 and 93, respectively. Pulley 116 and pinion 118 are disposed above cam gear 100 so that pinion 118 is in driving engagement with gear 112. Motor 67 includes a drive shaft 122 on which a pulley 123 is pressfit or otherwise secured for rotation with the drive shaft. A belt 124 drivingly connects pulley 116 and pulley 123. Thus, rotation of motor 67 will, through belt 124 and pulley 116, together with engagement of gears 118 and 112, rotate cam gear 100.

Pivotally mounted between back housing portion 61 and front housing portion 62 is a pivoting link 128 which is best illustrated in FIG. 10. Pivoting link 128 has a lower cam follower 129 with an oval opening 130. Extending upwardly from cam follower 129 is a standard 131. A transverse pin 133 extends on both sides of the standard, intermediate the ends of the standard. In addition, there is a second transverse pin 135 extending rearwardly from adjacent the top of standard 131. One end of pin 133 is received in bore 73 of seat 72 and the other end of pin 133 is received in bore 98 of plate 97. Pivoting link 128 is thus mounted between back housing portion 61 and front housing portion 62 for pivotal movement about the axis of pin 133. With pivoting link 128 so mounted, oval opening 130 of cam follower 129 fits over cam 114 on the forward face of cam gear 100. Accordingly, it will be appreciated that as cam gear 100 rotates about the axis of shaft 101, the engagement of cam follower 129 with cam 114 effects a side to side pivotal movement of pivoting link 128 about the axis of pin 133.

Also mounted for pivotal movement within torso 22 is a head mounting stem 138 which has a bore 139 extending through the stem intermediate the ends of the stem. Bore 139 is of a diameter that will fit over post 44 such that stem 138 may pivot about the axis of post 44. As will be best appreciated from FIG. 3, when torso parts 42 and 43 are secured together, stem 138 will be trapped between boss 45 and a sleeve 142 that is fitted over post 44. Adjacent the lower end of head mounting stem 138 is an opening 143 which is elongated in the same direction as stem 138. Rearwardly extending pin 135 of link 128 is received in elongated opening 143 such that side to side pivotal movement of link 128 effects side to side lateral pivoting of stem 138. Adjacent the top of stem 138 is a connector 144 having an annular recess 145.

Figure 2:
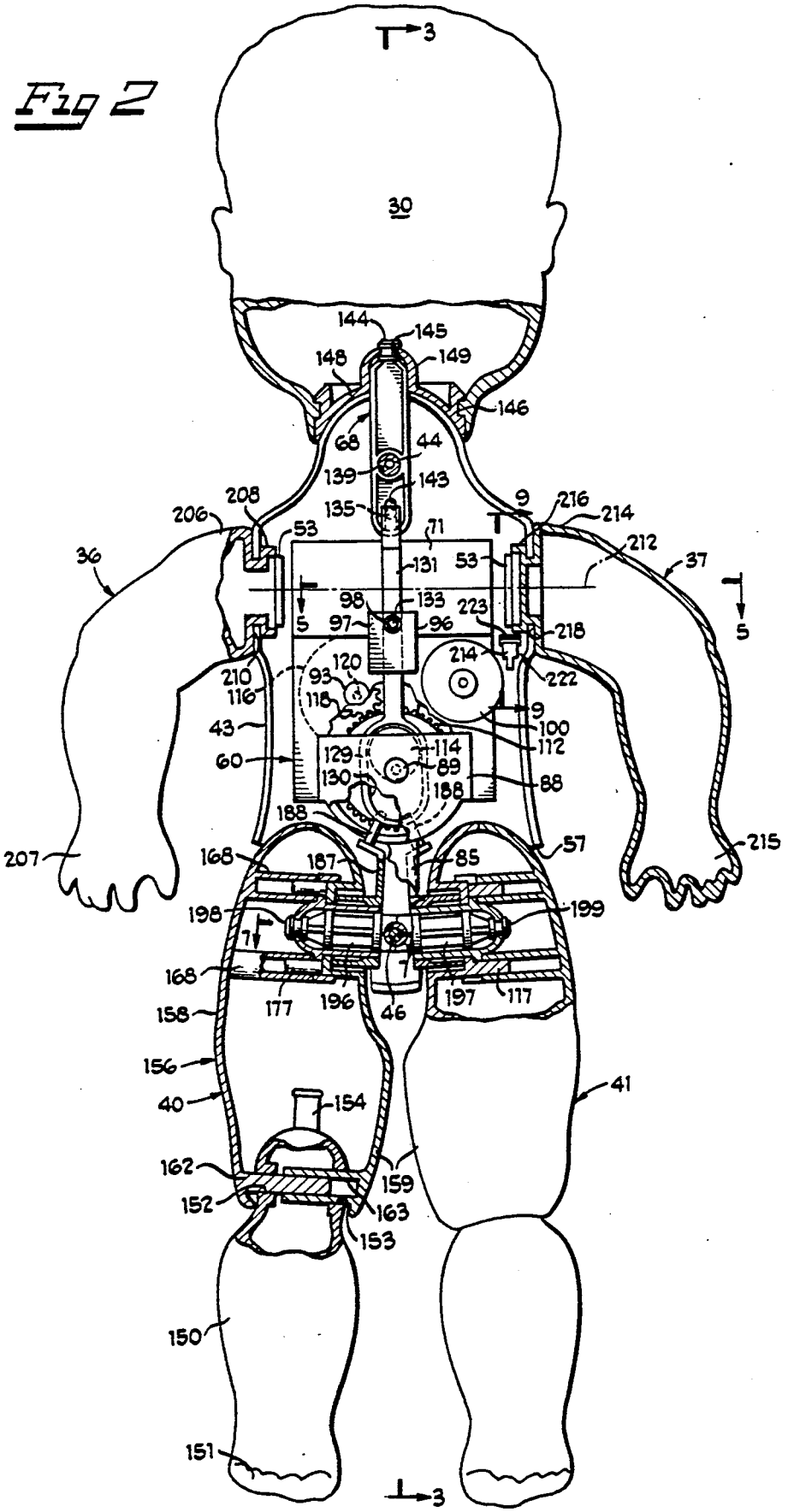
FIG. 2 is an enlarged scale elevational view, partially in section taken generally along line 2—2 of FIG. 1.

Head 30 is, as illustrated in FIGS. 2 and 3, secured about an annular recess 146 of a head mounting plug 147 which includes a generally hemispherical bottom surface 148 that corresponds to the generally hemispherical shape of neck end 24 such that head 30 may move from side to side. Plug 147 has a generally centrally disposed upper, apertured receptacle 149 through which connector 144 is forced and then retained by the engagement of receptacle 149 about annular recess 145. Head mounting plug 147 is conveniently made of a relatively resilient material such as polypropylene to facilitate such insertion and retention of connector 144. Stem 138 is thus secured by connector 144 to head mounting plug 147. Accordingly, when motor 67 is actuated to drive cam gear 100, head 130 will be driven, by link 128 and stem 138, in a side to side pivoting movement. Such side to side pivoting movement simulates the side to side movement of a toddler's head that often accompanies the toddler's initial attempts to walk.

Each of legs 40 and 41 are similar constructed, and hence the details of only right leg 40 will be further described. Leg 40 includes a lower calf 150 having a simulated foot 151 adjacent its lower end. Adjacent the upper end of calf 150 are axially aligned cylindrical bores 152 and 153 extending through each side of the calf. Projecting generally upwardly and rearwardly from the upper end of calf 150 is a tab 154.

In addition to calf 150, leg 40 includes thigh 156 which is formed of mating pieces 158 and 159. Adjacent the lower end of thigh 156, piece 158 includes an inwardly projecting post 162 that is received in a blind bore boss 163 extending inwardly from piece 159. Post 162 passes through bore 152 while boss 163 passes through bore 153. Accordingly, calf 150 is pivotally connected to thigh 156. Inner thigh piece 159 includes an inwardly extending projection 165 which is shown in FIG. 3. Tab 154 of calf 150 abuts projection 165 to limit the forward pivotal movement of calf 150 with respect to thigh 156. Adjacent its upper end, outer thigh piece 158 includes a pair of spaced apart, apertured inwardly extending blind bore bosses 168. Opposite bosses 168, adjacent the upper end of piece shell 159 is a recessed well 169 having a bottom wall 170. Extending inwardly from the bottom wall 170 of well 169 are a pair of spaced apart posts 171 that are insertable in frictional engagement in blind bore bosses 168. In bottom wall 170 of well 169 is a flanged opening 172.

Before outer thigh piece 158 and inner thigh piece 159 are secured together, a leg mounting plug 175 is positioned between the pieces. Plug 175 includes a flange 176 having generally diametrically opposed spaced apart apertures 177. Coaxial with flange 176 from flange 176 is a cylindrical sleeve 179 that opens and extends generally inwardly with respect to the center of the doll. There is also an outwardly extending hemispherical projection 180 on the opposite side of flange 176. Projection 180 has a generally centrally disposed opening 181 that is coaxial with sleeve 179. Plug 175 is positioned with sleeve 179 fitting through opening 172 in well 169 and each of pins 171 extending through a respective aperture 177 in flange 176 before fitting into apertured bosses 168. The outer cylindrical surface of sleeve 179 is, as illustrated in the enlarged fragmentary sectional view of FIG. 8, formed with a series of indentations 182 spaced about the periphery of the outer surface.

Figure 8:
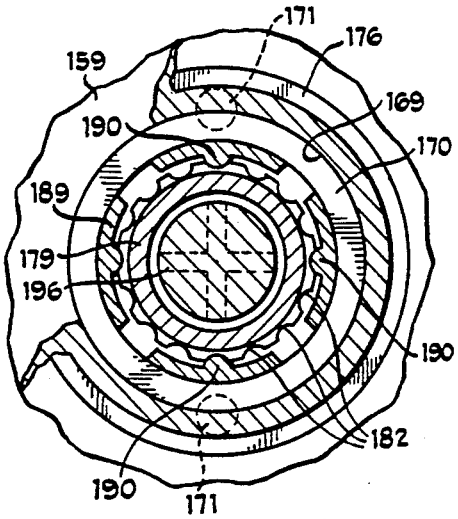
FIG. 8 is a fragmentary sectional view taken generally along line 8—8 of FIG. 7.

Engageable with leg plug 175, or more particularly, sleeve 179, is a drive clutch member 185 which is shown in its entirety in FIG. 10. Member 185 includes a lower clutch segment 186 and an upper cam follower 187. Lower clutch segment 186 comprises a slotted cylindrical sleeve 189 having a pair of generally diametrically opposed inwardly directed detents 190. Slotted cylindrical sleeve 189 fits over sleeve 179 with, as illustrated in FIG. 8, each of detents 190 fitting into, and being in engagement with, a corresponding indentation 182. Thus, piece 185 and plug 175 are in driving engagement with each other and plug 175, through which pins 171 fit, is in driving engagement with leg 40. Cam follower 187 includes a projecting pin 188 which is received in cam slot 110. As is best shown in FIG. 2, the corresponding cam follower for left leg 41 engages cam slot 110 on the opposite side of the slot from the cam follower 187 for right leg 40.

Legs 40 and 41 are mounted for pivotal movement with respect to torso 22 by shaft 195. Extending generally laterally outwardly from the center of shaft 195 are a pair of generally opposed leg mounting stems 196 and 197. At the end of each stem 196 and 197 is a respective connector 198 and 199. Each connector 198 and 199 has an annular recess 200 such that when the end of connector 198 is pushed through opening 181 in leg plug 175, connector 198 is then secured against removal in the generally axial direction of leg stem 196. Leg plug 175 is conveniently made of a relatively resilient plastic such as polypropylene to facilitate such securement of connector 198. Transverse to stems 196 and 197 is a generally centrally disposed tubular sleeve 202 which fits over lower inwardly extending post 46 of front torso port 42. As is best illustrated in FIG. 3, sleeve 202 is trapped between upper housing portion 61 and lower housing portion 62. Leg mounting stems 196 and 197 are not coaxial; instead, as is best illustrated in FIG. 2, each extends at a slight upward angle away from sleeve 202. Accordingly, each of legs 40 and 41 are mounted for pivotal movement about an axis that intersects the central axis of torso 22. Thus, it will be appreciated that with each of legs 40 and 41 mounted as has been described, and with the respective cam follower for each of the legs in engagement with the generally sinusoidally angling cam slot 110, each of legs 40 and 41 will be driven in a counter reciprocating, out-of-phase, pivotal simulating walking motion.

Right arm 36 has a shoulder end 206 and a hand end 207. On the body side of shoulder 206 there is a flange 208 which defines an annular recess 210. When arm 36 is fitted to torso 22 with flange 208 in proximity to abutment or wall 52 and 53 extending inwardly from torso part 42 and rear torso part 43, respectively, the portions of front torso part 42 and rear torso part 43 forming semi-circular openings 50 and 51, respectively, fit into annular recess 210. Accordingly, arm 36 is carried by torso 22 for pivotal or rotational movement about a lateral axis 212 that is substantially transverse to central axis 28 of the torso. Left arm 37 is similarly formed with a shoulder end 214 and a hand end 215. As with right arm 36, a flange 216 projects inwardly from the body side of shoulder end 214 and defines an annular recess 218. When arm 37 is fitted into torso 22, flange 216 is in proximity to the abutment formed by walls 52 and 53 and the portions of front torso part 42 and rear torso part 43 forming semi circular openings 50 and 51, respectively, are received in annular recess 218. Thus, arm 37 is similarly mounted about substantially the same lateral axis 212 for rotational movement relative to torso 22.

Figure 11:
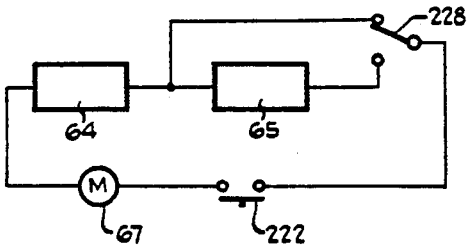
FIG. 11 is a schematic of the control circuit.
Figure 7:
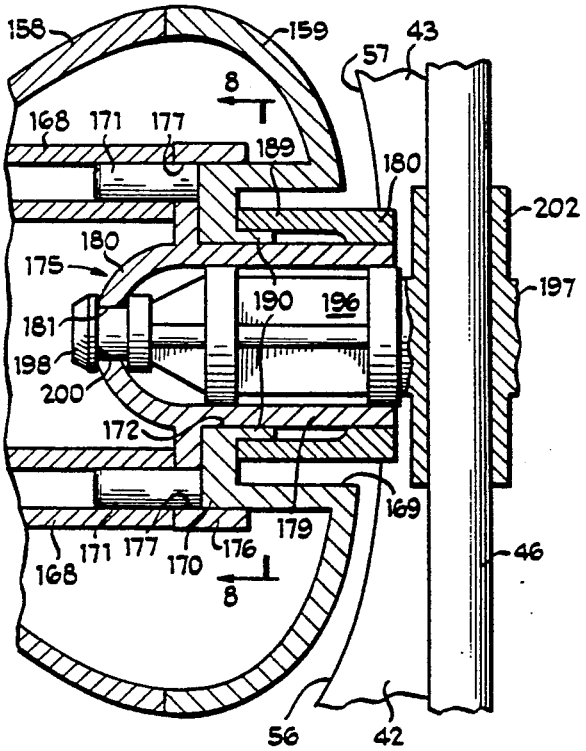
FIG. 7 is an enlarged fragmentary sectional view taken generally along line 7—7 of FIG. 2.
Figure 9:
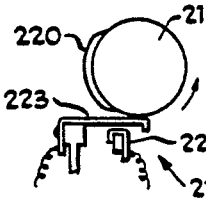
FIG. 9 is a fragmentary view taken generally along line 9—9 of FIG. 2.

As is best shown in FIG. 9, flange 216 includes an edge cam 220. Disposed below, and in proximity to, flange 216 is a switch 222 which is, as best illustrated in FIG. 11, connected by suitable wiring (not shown) between motor 67 and batteries 64 and 65. Switch 222 includes a movable biased leaf 223 and a fixed contact 224. Flange 216, as shown in FIG. 9, is in a rotational position corresponding to a downward orientation of arm 37 such as is illustrated in FIG. 2 and switch 222 is open. In the rotational position shown in FIG. 9, switch 222 is open because leaf 223 is biased away from contact 224. However, as arm 37 is rotated upwardly, flange 216 will rotate counterclockwise in the direction of the arrow illustrated in FIG. 9 and bring edge cam 220 into engagement with leaf 223 and move leaf 223 into electrical contact with contact 224 thus closing switch 222.

Figure 6:
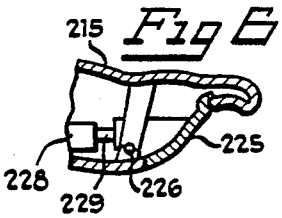
FIG. 6 is a fragmentary sectional view taken generally along line 6—6 of FIG. 5.

Hand 215 includes a pivotally depressible palm portion 225. As is best shown in FIG. 6, palm portion 225 is carried by hand 215 for limited inward pivotal movement about pin 226. Also carried by hand 215 is a switch 228 having an outwardly biased plunger 229. As illustrated in FIG. 11, switch 228 is connected between motor 67 and the batteries by suitable wiring (not shown) that extends througharm 37. Switch 228 is disposed in such proximity to depressible palm portion 225 that inward pivotal movement of depressible palm portion 225 moves plunger 229 against its bias. When palm portion 225 is not depressed, switch 228, with switch 222 closed, completes a circuit that connects only one of the batteries to motor 67. However, when palm portion 225 is depressed, switch 228 is, again with switch 222 closed, moved to close another circuit that increases the power to motor 67 by connecting both of batteries 64 and 65 to the motor. It will be appreciated from FIG. 11 that regardless of the position of switch 228, it is necessary to first close switch 222 by rotating arm 37 upward in order to energize motor 67. Once switch 222 is closed, switch 228 may be selectively actuated to increase the power to the motor.

To simulate doll 20 walking, the user manipulates arm 37 by grasping hands 207 and 215 and rotating arms 36 and 37 to an upraised position which permits the user to support some of the weight of the doll. By rotating arm 37 to the upraised position, switch 222 is closed and motor 67, powered by one battery, is actuated to drive legs 40 and 41 in the asynchronous pivotal movement that simulates walking. At such time as the user desires to simulate the doll walking at a faster speed in apparent response to encouragement by the user, palm portion 225 is selectively depressed resulting in actuation of motor 67 by both batteries. As a result of the additional power, motor 67 is driven at a faster rate and hence legs 40 and 41 move at a faster speed.

While a particular embodiment of the present invention has been shown and described, variation and modifications will occur to those skilled in the art. It is intended in the appended claims to cover all such variations and modification as fall within the true spirit and scope of the present invention.

What is claimed as new and desired to be secured by Letters Patents is:

1. A doll comprising in combination:

a torso having an upper neck end and a lower pelvic end;

the torso having a central axis extending through the upper neck end and the lower pelvic end;

a head carried by the torso adjacent the upper neck end;

a pair of legs carried by the torso adjacent the pelvic end;

each of the pair of legs being connected for a walking simulating, alternating pivotal movement about an axis that intersects the central axis of the torso;

a pair of arms carried by the torso;

each of the pair of arms having a shoulder end and a hand end;

the shoulder end of each of the arms being mounted to the torso adjacent the upper neck end of the torso;

an electrically powered motor carried by the torso;

a battery power source for the motor carried within a doll;

a circuit between the battery powered source and the motor;

means within the torso connecting the motor and the legs for driving the legs in a walking simulating, alternating pivotal movement;

means for control of the driven movement of the legs actuatable by user manipulation of the hand end of one of the arms, the control means operating to open and/or close the circuit between the battery power source and the motor;

means mounting the arms for rotational movement about an axis extending through the torso and shoulders, generally transverse to the central axis of the torso;

the control means being actuatable upon rotation of one of the arms about the axis extending through the torso and shoulders; and the control means including a switch carried by one of the hands.

2. The doll of claim 1 in which the one hand includes a portion that is depressible with respect to the rest of the hand for actuation of the switch.

3. The doll of claim 2 in which:

the battery power source includes a plurality of batteries;

means connecting the plurality of batteries to the motor so that the control means actuatable by rotation of the one arm controls a circuit that energized the motor regardless of the position of the hand actuatable switch; and additional means connecting the plurality of batteries to the motor so that the hand actuatable switch selectively connects some or all of the plurality of batteries to the motor after the control means actuatable by rotation of the arm closes the circuit.

the battery power source includes a plurality of batteries;

means connecting the plurality of batteries to the motor so that the control means actuatable by rotation of the one arm controls a circuit that energizes the motor regardless of the position of the hand actuatable switch; and additional means connecting the plurality of batteries to the motor so that the hand actuatable switch selectively connects some or al of the plurality of batteries to the motor after the control means actuatable by rotation of the arm closes the circuit.

4. The doll of claim 1 in which:

the battery power source includes a plurality of batteries;

means connecting the plurality of batteries to the motor so that the control means actuatable by rotation of the one arm controls a circuit that energizes the motor regardless of the position of the hand actuatable switch; and additional means connecting the plurality of batteries to the motor so that the hand actuatable switch selectively connects some or all of the plurality of batteries to the motor after the control means actuatable by rotation of the arm closes the circuit.

5. A doll comprising in combination:

a torso having an upper neck end and a lower pelvic end;

the torso having a central axis extending through the upper neck end and the lower pelvic end;

a head carried by the torso adjacent the upper neck end;

a pair of legs carried by the torso adjacent the pelvic end;

each of the pair of legs being connected for a walking simulating, alternating pivotal movement about an axis that intersects the central axis of the torso;

a pair of arms carried by the torso;

each of the pair of arms having a shoulder end and a hand end;

the shoulder end of each of the arms being mounted to the torso adjacent the upper neck end of the torso;

an electrically powered motor carried by the torso;

a battery power source for the motor carried within the doll;

a circuit between the battery power source and the motor;

means within the torso connecting the motor and the legs for driving the legs in a walking simulating, alternating pivotal movement;

means for control of the driven movement of the legs actuatable by user manipulation if the hand end of one of the arms, the control means operating to open and/or close the circuit between the battery power source and the motor;

means mounting the arms for rotational movement about an axis extending through the torso and shoulders, generally transverse to the central axis of the torso;

the control means being actuatable upon rotation of one of the arms about the axis extending through the torso and shoulders; and the control means further including a switch carried by the hand of the one arm.

6. The doll of claim 5 in which the hand of the one arm includes a portion that is depressible with respect to the rest of the hand for actuation of the switch.

7. The doll of claim 6 in which:

the battery power source includes a plurality of batteries;

means connecting the plurality of batteries to the motor so that the control means actuatable by rotation of the one arm controls a circuit that energizes the motor regardless of the position of the hand actuatable switch; and additional means connecting the plurality of batteries to the motor so that the hand actuatable switch selectively connects some or all of the plurality of batteries to the motor after the control means actuatable by rotation of the arm closes the circuit.

8. The doll of claim 5 in which:

the battery power source includes a plurality of batteries;

means connecting the plurality of batteries to the motor so that the control means actuatable by rotation of the one arm controls a circuit that energizes the motor regardless of the position of the hand actuatable switch; and additional means connecting the plurality of batteries to the motor so that the hand actuatable switch selectively connects some or all of the plurality of batteries to the motor after the control means actuatable by rotation of the closes the circuit.

* * * * *